US007357226B2

(12) United States Patent
Sakita

(10) Patent No.: US 7,357,226 B2
(45) Date of Patent: Apr. 15, 2008

(54) ELEVATOR SYSTEM WITH MULTIPLE CARS IN THE SAME HOISTWAY

(76) Inventor: Masami Sakita, P.O. Box 61089, Palo Alto, CA (US) 94306-1089

( * ) Notice: Subject to any disclaimer, the term of this patent is extended or adjusted under 35 U.S.C. 154(b) by 462 days.

(21) Appl. No.: 11/168,729

(22) Filed: Jun. 28, 2005

(65) Prior Publication Data

US 2006/0289240 A1 Dec. 28, 2006

(51) Int. Cl.
*B66B 9/00* (2006.01)

(52) U.S. Cl. ..... 187/249; 187/391

(58) Field of Classification Search ..... 187/247, 187/248, 249, 380–387, 391–393
See application file for complete search history.

(56) References Cited

U.S. PATENT DOCUMENTS

| | | | | |
|---|---|---|---|---|
| RE18,095 | E | 6/1931 | Sprague | |
| 1,837,643 | A | 12/1931 | Anderson | |
| 1,976,495 | A | 10/1934 | Halfvarson | |
| 5,419,414 | A | 5/1995 | Sakita | |
| 5,663,538 | A | 9/1997 | Sakita | |
| 5,699,879 | A | 12/1997 | Sakita | |
| 5,877,462 | A * | 3/1999 | Chenais | 187/249 |
| 6,273,217 | B1 | 8/2001 | Hikita | |
| 6,364,065 | B1 * | 4/2002 | Hikita | 187/382 |
| 6,508,333 | B2 | 1/2003 | Kostka | |
| 7,032,716 | B2 * | 4/2006 | Meyle et al. | 187/382 |

* cited by examiner

*Primary Examiner*—Jonathan Salata

(57) ABSTRACT

The elevator system of this present invention for multistory buildings includes at least one elevator shaft, each of which having a plurality of elevator units and at least one interlocking means, and an elevator control system. The elevator unit includes an elevator car and its guide means, a counterweight and its guide means, a drive means, and an elevator control system. The interlocking means includes a coupling mechanism and a bi-directional one-way clutch mechanism, and connecting means such as gears. The elevator system is operated by a plurality of computers including the schedule computer, shaft computers, and car computers. The acceleration (and deceleration) rate of the following elevator car is determined from the distance between the car and its leading car, the speeds of the two cars, and the acceleration rate of the leading car.

16 Claims, 16 Drawing Sheets

ELEVATOR SYSTEM WITH MULTIPLE CARS IN THE SAME HOISTWAY

FIELD OF THE INVENTION

This invention relates generally to an elevator system that has a plurality of cars in one hoistway.

BACKGROUND OF THE INVENTION

The idea of an elevator system with a plurality of cars in the same hoistway has been around for over 70 years. See, for example, U.S. Pat. No. Re. 18,095 by Sprague, U.S. Pat. No. 1,837,643 by J. N. Anderson, and U.S. Pat. No. 1,911,834 by D. L. Lindquist. Sprague's elevator system, which was called Dual Elevator system, was put in service in 1931 in a 20-story building in Pittsburgh. His Dual Elevator system has two independently movable cars in one shaft with the upper car serving the upper half and the lower car the lower half of the building. It is reported that the Dual Elevator system was not successful and eventually had to be taken out of service. Since then, a handful of patents have been issued on this subject, but no full blown working elevator systems of this sort have been put in service. The reason for this may be that none of the proposed systems have been able to show that they are safe enough to operate and their shaft capacity can be high enough for the price of the system.

OBJECTS OF THE INVENTION

An object of this invention is the provision of an elevator system that has a high shaft capacity.

An object of this invention is the provision of an elevator system that is safe to ride.

SUMMARY OF THE INVENTION

The elevator system of this present invention for multi-story buildings includes at least one elevator shaft, each of which having a plurality of elevator units and at least one interlocking means, and an elevator control system. The elevator unit includes an elevator car and its guide means, a counterweight and its guide means, and a drive means. Number of elevator units in one shaft may be two or three. The drive means includes a motor with a driveshaft, hoist cables and compensating cables, a traction sheave, a brake mechanism and guide sheaves. The interlocking means includes a coupling mechanism and a bi-directional one-way clutch mechanism, and connecting means such as gears. The brake mechanism includes a disc that is affixed to the drive shaft and a brake shoe that grabs the disc at the time of braking. The coupling mechanism connects and disconnects the driveshaft of one elevator unit with the driveshaft of another elevator unit. The bi-directional one-way clutch mechanism allows all the driveshafts to rotate only in a given direction at a time. The elevator cars in one shaft may be any combination of single- and double-deckers.

The elevator control system comprises a schedule computer, at least one shaft control system that includes a shaft computer, and a plurality of elevator car control systems wherein each of which includes a car computer. The acceleration/deceleration rate of the following elevator car in the next $\delta t$ sec is determined from such factors as the current estimated distance between the car and its leading car, the estimated speeds and acceleration rates of the two cars in the immediate past $\delta t$ sec.

BRIEF DESCRIPTION OF THE DRAWINGS

The above and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
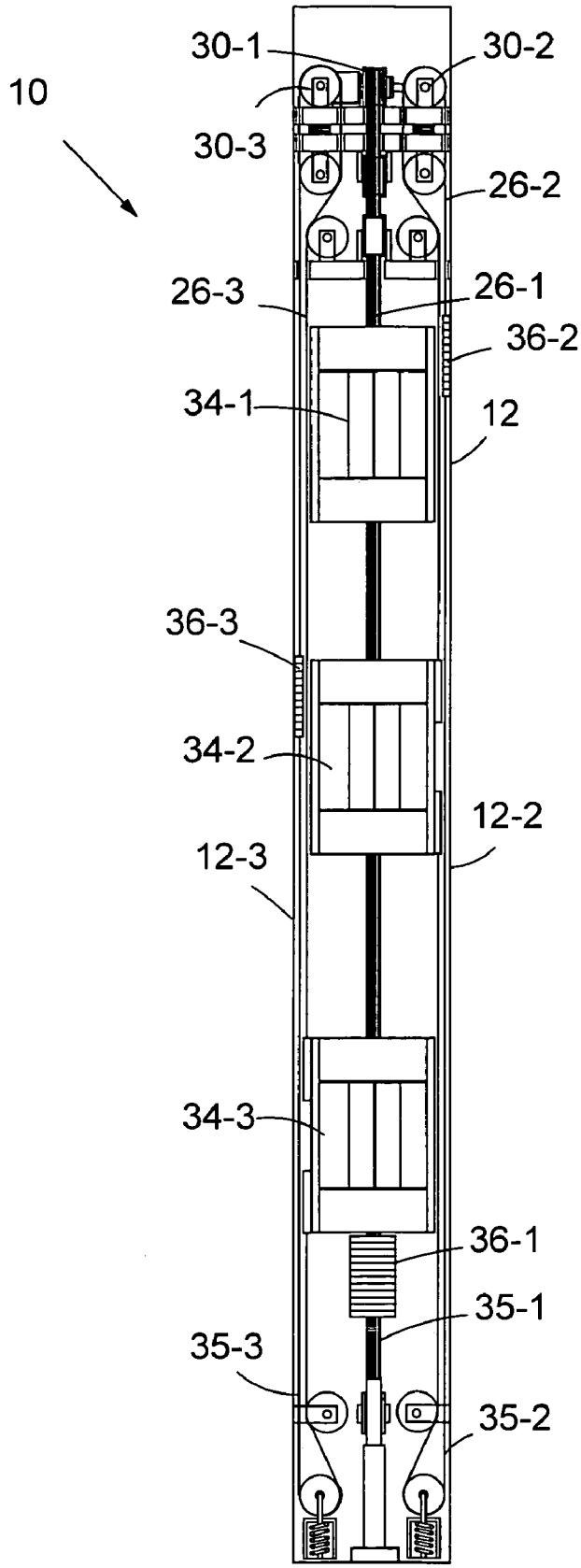
FIG. 1 shows a simplified front view of an elevator system of the preferred embodiment of the present invention.

Reference is now made to FIG. 1 wherein a simplified front view of a shaft 12 of an elevator system 10 of the preferred embodiment of the present invention for a multi-story building is shown. The elevator system 10 includes at least one elevator shaft 12, each of which having a front wall with doorways with doors, rear wall 12-1 (not shown), first sidewall 12-2 and second sidewall 12-3, at least one interlocking means, and an elevator control system 60 (not shown). Each shaft has at least two elevator units, and as many as three elevator units 30-1, 30-2, and 30-3. The elevator unit 30-1 includes an elevator car 34-1 and its guide means, a counterweight 36-1 and its guide means, a drive means 20-1 that includes a motor, hoist cables 26-1 and sheaves, and compensating cables 35-1 and sheaves. The elevator unit 30-2 includes an elevator car 34-2 and its guide means, a counterweight 36-2 and its guide means, a drive means 20-2 (not shown in FIG. 1, but shown in FIG. 2) that includes a motor, hoist cables 26-2 and sheaves, and compensating cables 35-2 and sheaves. The elevator unit 30-3 includes an elevator car 34-3 and its guide means, a counterweight 36-3 and its guide means, a drive means 20-3 (not shown in FIG. 1, but shown in FIG. 2) that includes a motor, hoist cables 26-3 and sheaves, and compensating cables 35-3 and sheaves. The suffix 1 represents the elevator unit 30-1; the suffix 2 represents the elevator unit 30-2; and the suffix 3 represents the elevator unit 30-3.

Figure 2:
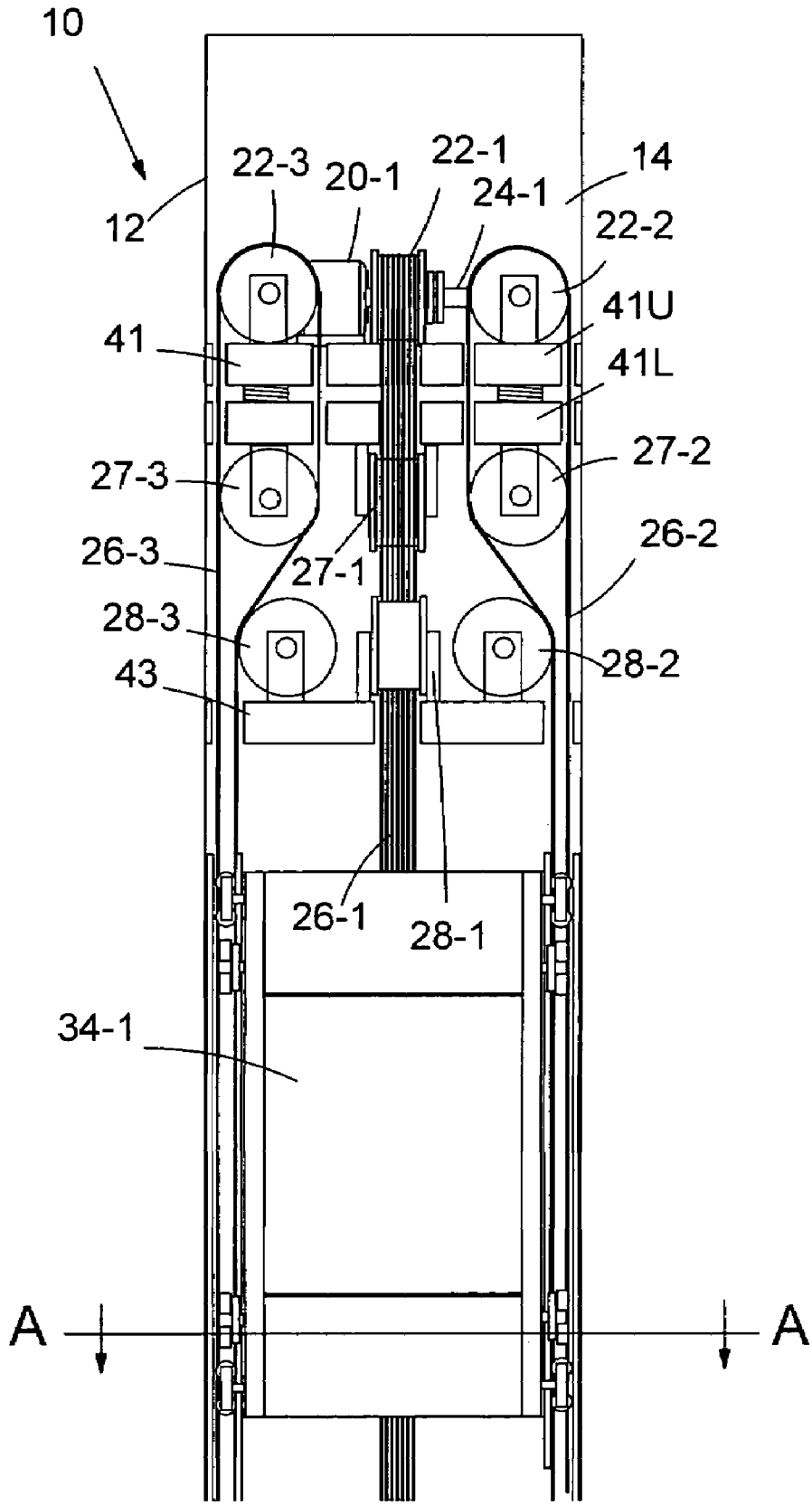
FIG. 2 shows a front view of the machine room and its vicinity of the elevator system of the preferred embodiment of the present invention.
Figure 3:
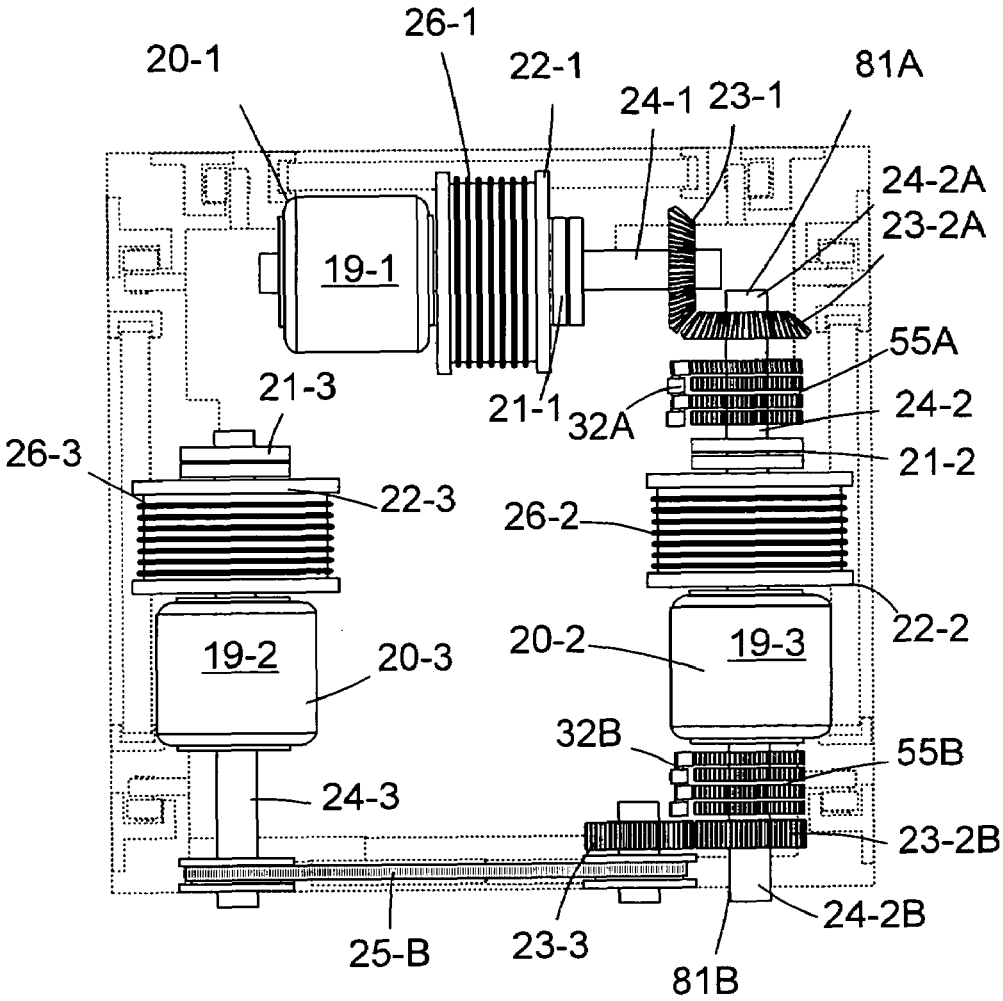
FIG. 3 shows a top view of the machine room of the elevator system of the preferred embodiment of the present invention.

Reference is now made to FIG. 2 wherein a front view of the machine room 14 and its vicinity of the elevator system 10 is shown, and to FIG. 3 wherein a top view of the machine room of the elevator system 10 is shown. The machine room 14 has platforms 41 and 43 that support the drive means 20-1 of the elevator unit 30-1, the drive means 20-2 of the elevator unit 30-2, the drive means 20-3 of the elevator unit 30-3, interlocking means 81A that interlocks the drive means 20-1 and 20-2, and interlocking means 81B that interlocks the drive means 20-2 and 203.

The drive means 20-1 includes a motor 19-1 with the driveshaft 24-1, the hoist cables 26-1, a traction sheave 22-1, a brake mechanism 21-1, guide sheaves 27-1 and 28-1, and the compensating cables 35-1 and guide sheaves. The brake mechanism 21-1 includes a disc that is affixed to the drive shaft 24-1 and a brake shoe that grabs the disc at the time of braking. The drive means 20-2 includes a motor 19-2 with the driveshaft 24-2, the hoist cables 26-2, a traction sheave 22-2, a brake mechanism 21-2, guide sheaves 27-2 and 28-2, and the compensating cables 35-2 and guide sheaves. The drive means 20-3 includes a motor 19-3 with a driveshaft 24-3, the hoist cables 26-3, a traction sheave 22-3, a brake mechanism 21-3, guide sheaves 27-3 and 28-3, and the compensating cables 35-3 and guide sheaves.

The interlocking means 81A includes a bevel gear 23-1 affixed to the driveshaft 24-1, and another bevel gear 23-2A affixed to a driveshaft extension 24-2A, wherein the bevel gears 23-1 and 23-2A rotatably connecting the driveshaft 24-1 with the driveshaft extension 24-2A, and a coupling mechanism 55A, a bidirectional one-way clutch 32A. The driveshaft extension 24-2A shares an axis with the rotational axis of the driveshaft 24-2 of the drive means 20-2, and extends along the axis of the driveshaft 24-2. Both the coupling means 55A and the bi-directional one-way clutch mechanism 32A are partly affixed to the driveshaft extension 24-2A and partly affixed to the driveshaft 24-2.

The interlocking means 81B includes a coupling mechanism 55B, a bi-directional one-way clutch 32B, a means 25-B that rotatably connects the driveshaft 24-3 and a driveshaft extension 24-2B, wherein the rotatably connecting means 25-B including pulleys, a chain and a gear 23-3, and a gear 23-2B affixed to the driveshaft extension 24-2B (and meshes with the gear 23-3). The driveshaft extension 24-2B shares an axis with the rotational axis of the driveshaft 24-2, and extends along the axis of the driveshaft 24-2. Both the coupling means 55B and the bi-directional one-way clutch mechanism 32B are partly affixed to the driveshaft extension 24-2B and partly affixed to the driveshaft 24-2. The coupling means 55A and 55B are clutches in the preferred embodiment. In a two-car per shaft elevator system, the preferred combination is of elevator units 30-2 and 30-3.

Figure 8:
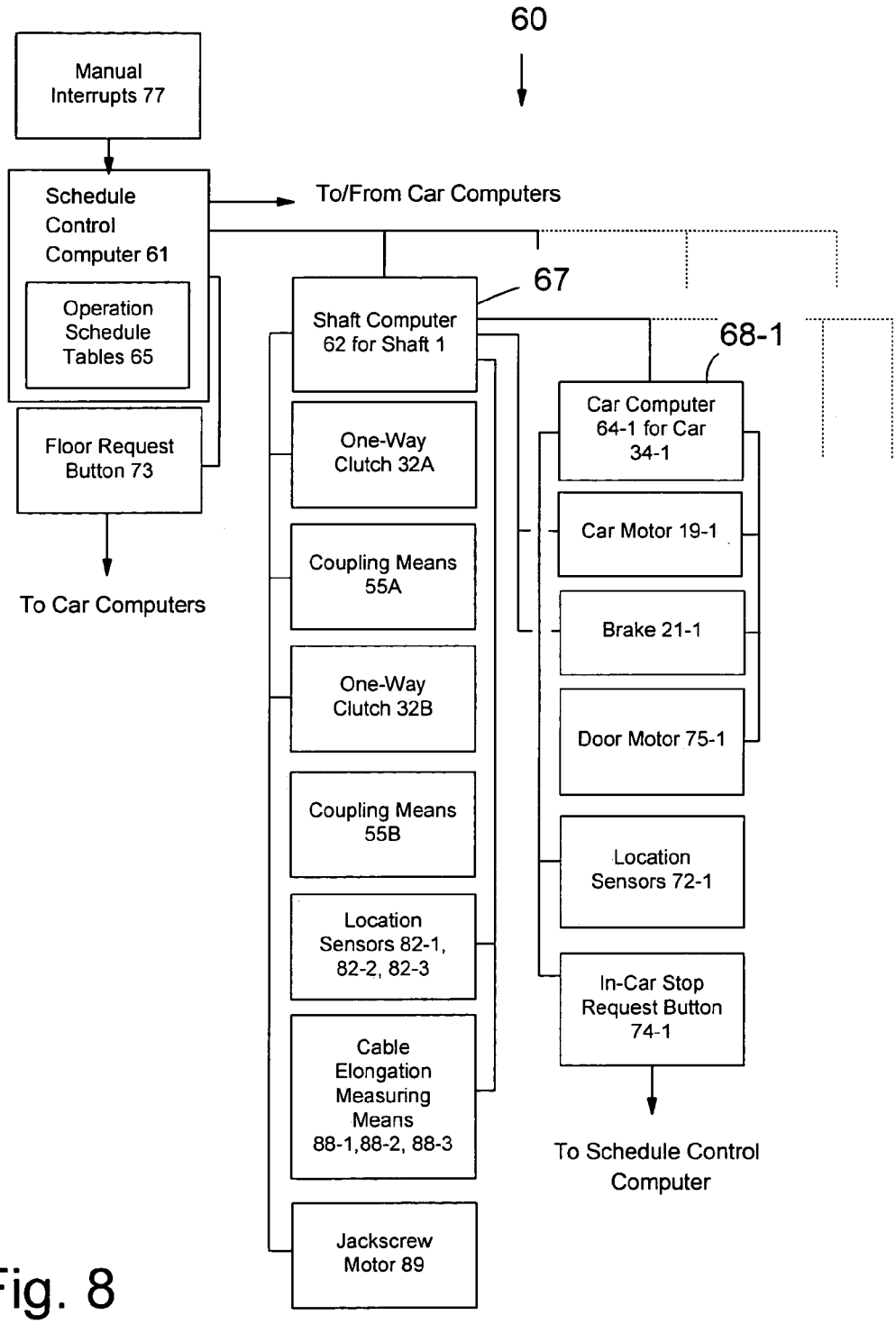
FIG. 8 is a simplified diagram that shows flow of information in the elevator control system.

The platform 41 comprises two layers—the upper layer and the lower layer (see FIG. 2), wherein the upper layer 41U to which the motors and the interlocking means is affixed to is supported by a plurality of jackscrews that are affixed to the lower layer 41L, and the upper layer 41U is vertically moved by a motor 89 (not shown in FIG. 2, but shown in FIG. 8). The lower layer 41L includes beams that are affixed to the structure of the elevator shaft 12.

Figure 4:
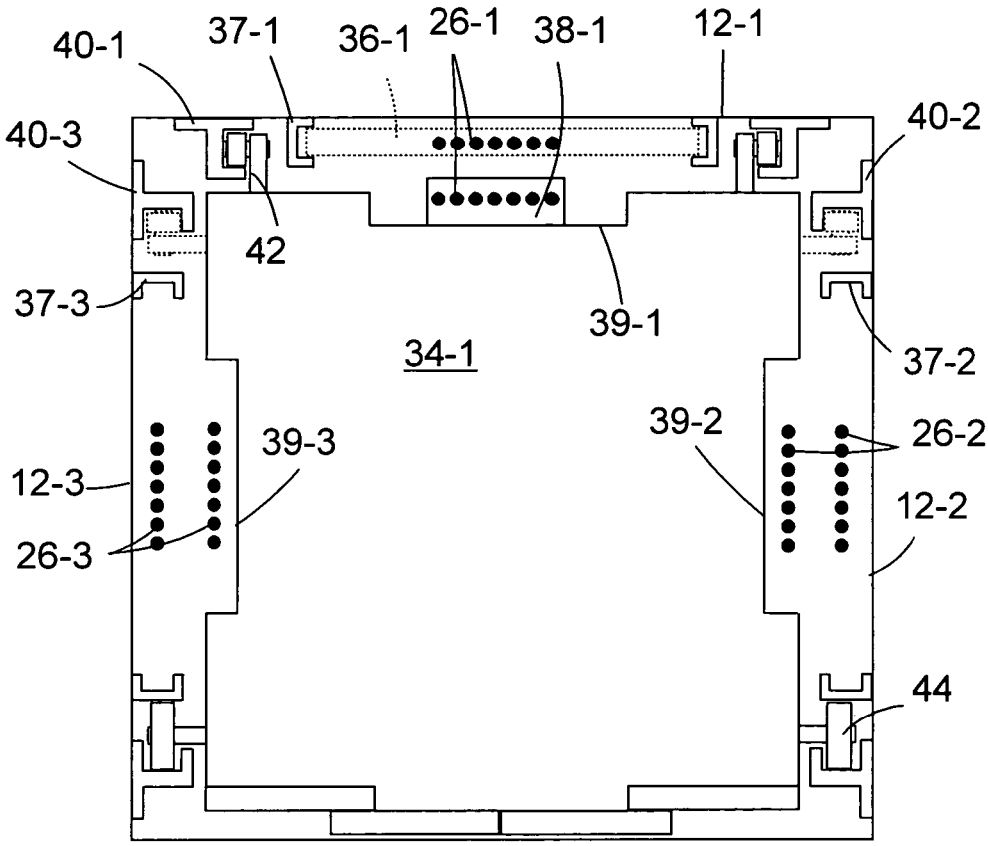
FIG. 4 shows a cross-sectional view of an elevator car and the elevator shaft taken along A-A of FIG. 2.

Reference is now made to FIG. 4 wherein a cross-sectional view of an elevator car 34-1 and the elevator shaft 12 taken along A-A of FIG. 2 is shown. The guide means of the elevator car 34-1 includes elevator car guide rails 40-1 affixed to the shaft wall 12-1, elevator car guide rails 40-2 affixed the shaft wall 12-2, elevator car guide rails 40-3 affixed the shaft wall 12-3, rollers 42 in which the roller surface is generally parallel to the shaft wall to which the guide rail is affixed, and rollers 44 in which the roller surface is generally perpendicular to the shaft wall to which the guide rail is affixed. Any number of rollers of either type 42, or 44 may be used as required. The guide rails 37-1 of the counterweight 36-1 are affixed to the shaft wall 12-1. Guide rails 37-2 are affixed to the shaft wall 12-2, and guide rails 37-3 are affixed to the shaft wall 12-3. The rear wall of the elevator car 34-1 that faces the shaft wall 12-1 has a recess 39-1, and lugs 38-1 that are affixed to the wall of the recess 39-1, and to one of which the hoist cables 26-1 are affixed, and to the other one the compensating cables 35-1 (not shown) are affixed. The two sidewalls of the elevator car 34-1 also have recesses 39-2 and 39-3. The recesses 39-2 and 39-3 are for side clearance of the hoist cables 26-2 and 26-3, respectively, and for side clearance of the compensating cables 35-2 and 35-3, respectively.

Figure 5:
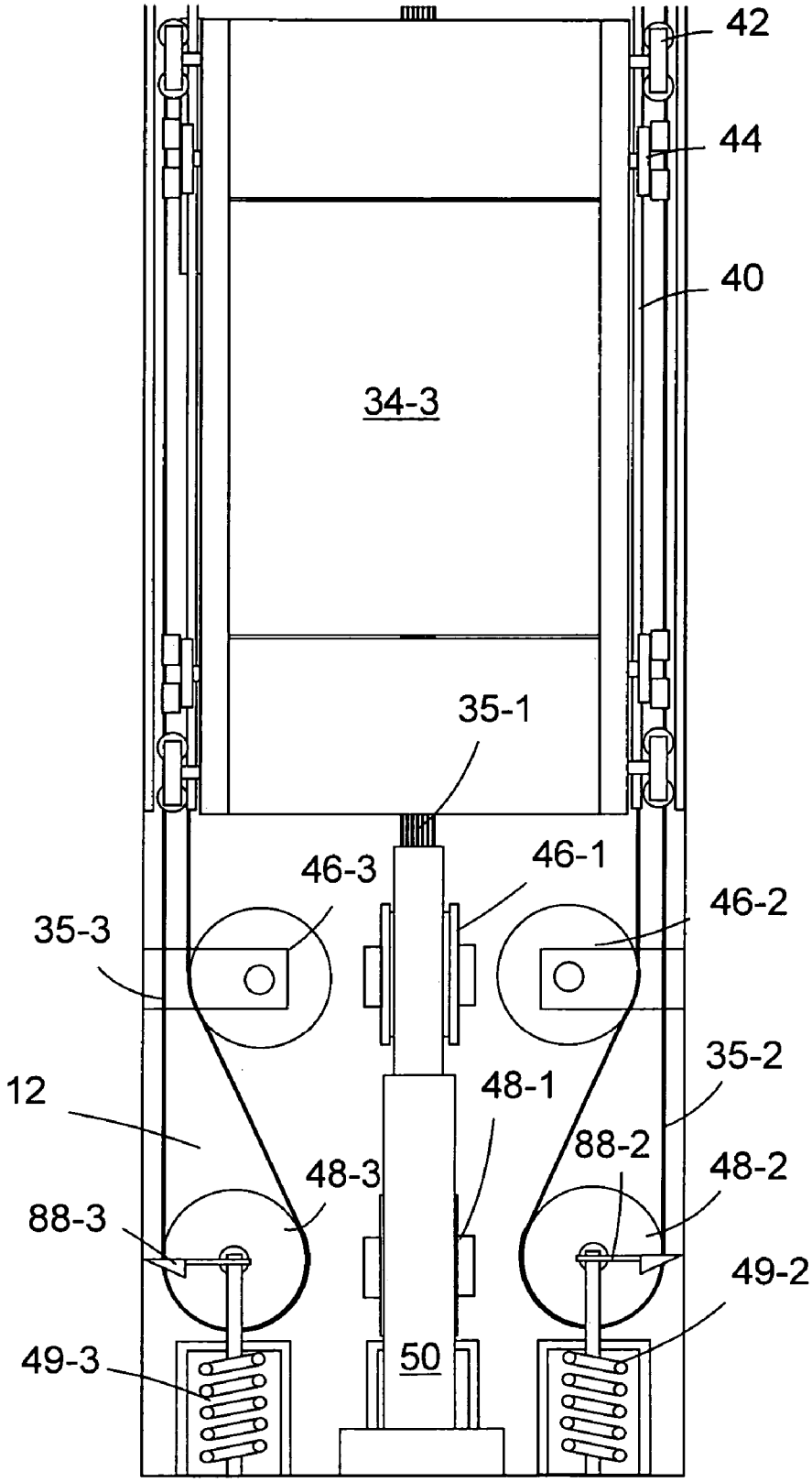
FIG. 5 shows a front view of an elevator car at near the bottom of the elevator shaft of the elevator system of the preferred embodiment of the present invention.

Reference is now made to FIG. 5 wherein a front view of an elevator car at near the bottom of the elevator shaft is shown. To give a proper amount of tension to the hoist cables and the compensating cables, the compensating cables 35-1, 35-2, and 35-3 are pulled down by shaves 48-1, 48-2 and 48-3, and pressed sideways by guide sheaves 46-1, 46-2 and 46-3, respectively. The sheaves 48-1, 48-2 and 48-3 are in turn pulled by springs 49-1, 49-2 and 49-3, respectively. Cable elongation measuring means 88-1, 88-2, and 88-3 measures the amount of elongation of the cables. A shock absorber 50 is installed at the bottom of the elevator shaft 12.

Figure 6:
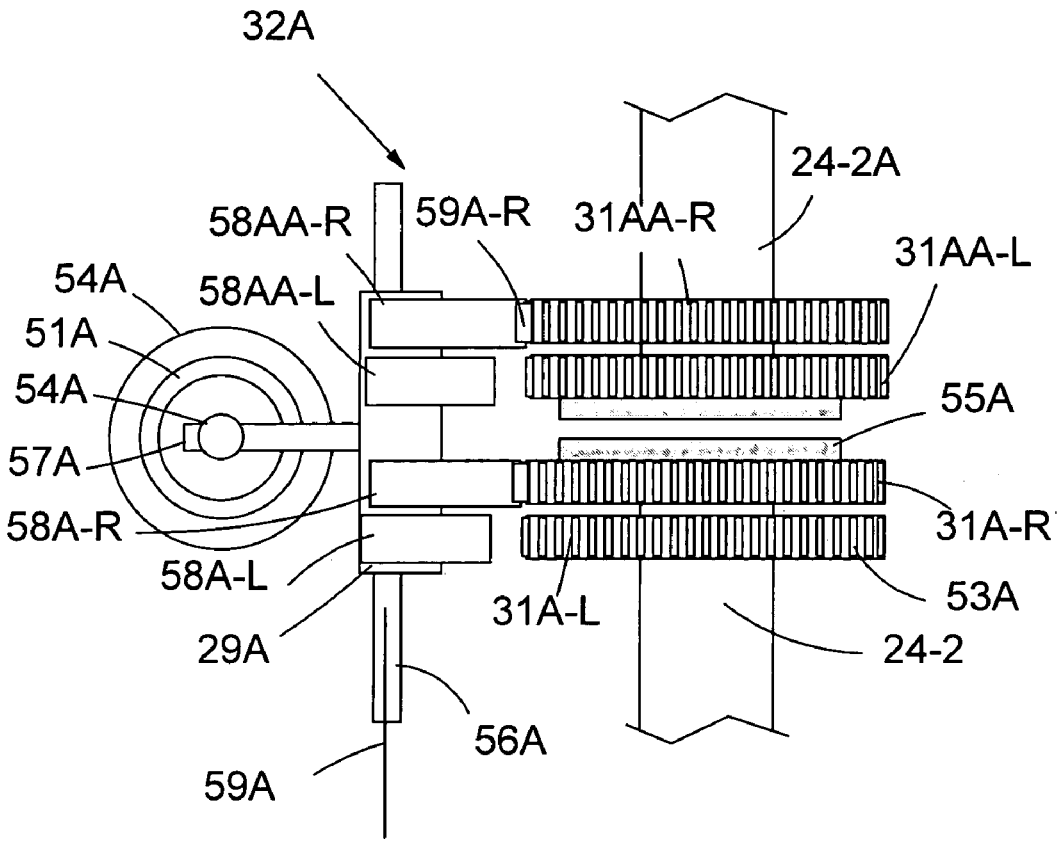
FIG. 6 shows a top view of a bidirectional clutch mechanism and a coupling mechanism.
Figure 7:
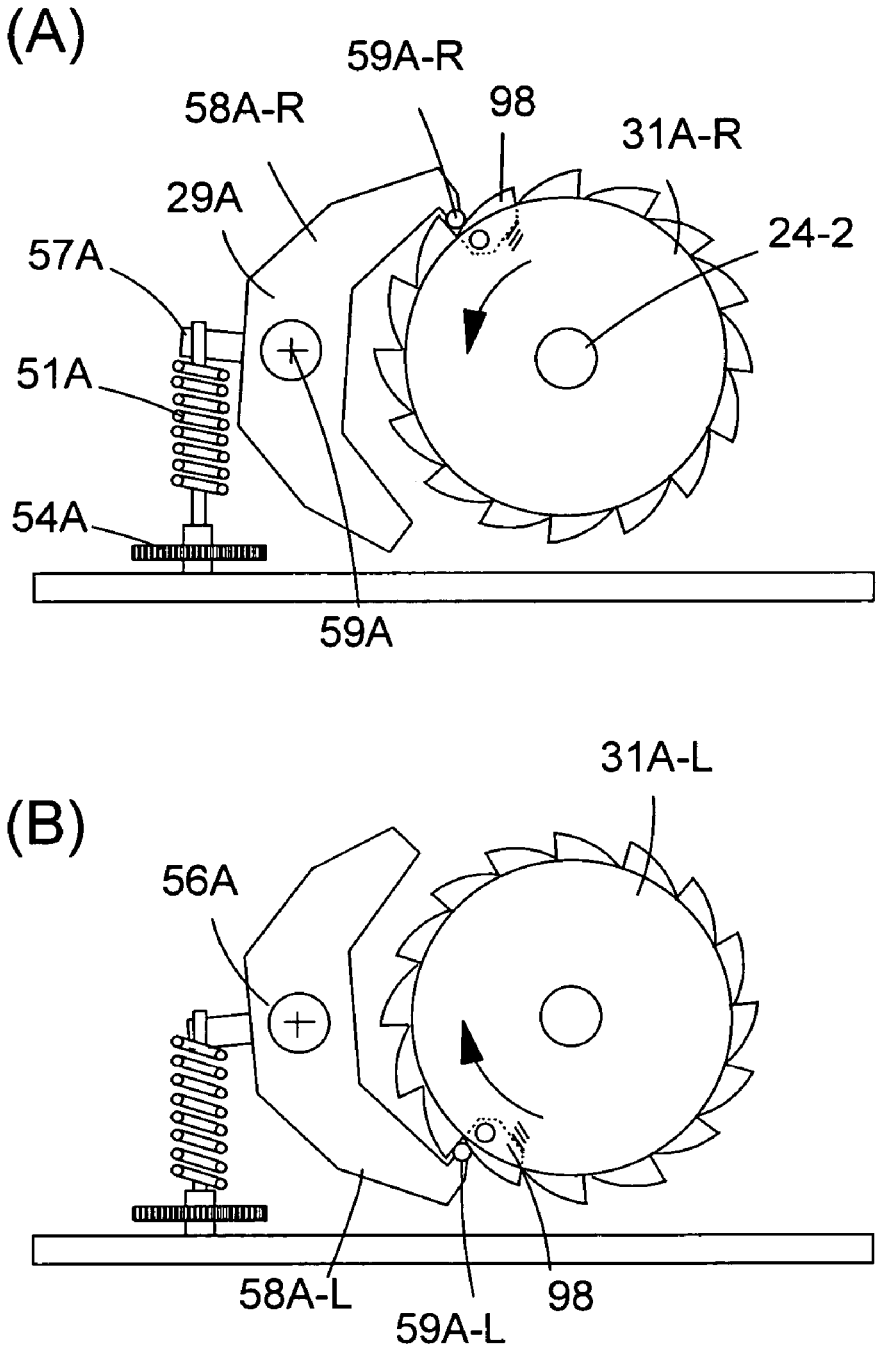
FIG. 7 shows lateral cross-sectional views of the one-way clutch mechanism.

Reference is now made to FIG. 6 wherein the bidirectional one-way clutch mechanism 32A, and the coupling mean 55A are shown, and to FIG. 7 wherein cross sectional views of the bidirectional one-way clutch mechanism 32A are shown. The bi-directional one-way clutch mechanism 32A includes a one-way clutch disc assembly 53A and a one-way clutch direction controller assembly 29A. The one-way clutch disc assembly 53A includes two one-way clutch discs 31A-R and 31A-L affixed to the drive shaft 24-2, and two one-way clutch discs 31AA-R and 31AA-L affixed to the driveshaft extension 24-2A. The one-way clutch direction controller assembly 29A includes one-way clutch direction controllers 29AA-R, 29AA-L, 29A-R, 29A-L, and a one-way clutch direction controller shaft 56A, wherein the one-way clutch direction controllers 58AA-R, 58AA-L, 58A-R, and 58A-L are affixed to the one-way clutch direction controller shaft 56A, which is pivotable about an axis 59A. The one-way clutch direction controller 58AA-R and the one-way clutch disc 31AA-R interface with each other; the one-way clutch direction controller 58AA-L and the one-way clutch disc 31AA-L interface with each other; the one-way clutch direction controller 58A-R and the one-way clutch disc 31A-R interface with each other [see FIG. 7-(A)]; and the key 58A-L and the one-way clutch disc 31A-L interface with each other see [FIG. 7-(B)].

Rollers 59A-R are affixed to contact points of the one-way clutch direction controllers 58AA-R and 58A-R, and rollers 59A-L are affixed to contact points of the one-way clutch direction controllers 58AA-L and 58A-L. When the one-way clutch direction controller 58AA-R engages with the clutch disc 31AA-R and the one-way clutch direction controller 58A-R engages with the clutch disc 31A-R, the one-way clutch direction controller 58AA-L automatically disengages with the clutch disc 31AA-L and the one-way clutch direction controller 58A-L automatically disengages with the clutch disc 31A-L. When the one-way clutch direction controller 58AA-L engages with the clutch disc 31AA-L and the one-way clutch direction controller 58A-L engages with the clutch disc 31A-L, the one-way clutch direction controller 58AA-R automatically disengages with the clutch disc 31AA-R and the one-way clutch direction controller 58A-R automatically disengages with the clutch disc 31A-R.

Teeth 98 affixed to the clutch discs 31A-R and 31AA-R are spring loaded and thus will be depressed as the rollers 59A-R contact and press them. Similarly, teeth 98 affixed to the clutch discs 31A-L and 31AA-L are spring loaded and thus will be depressed as the rollers 59A-L contact and press them.

A lever 57A affixed to the one-way clutch direction controller assembly 29A pulls downward or pushes upward the contact points of the one-way clutch direction controllers 58AA-R, 58AA-L, 58A-R, and 58A-L. The lever 57A is affixed to a spring 51A, which in turn is affixed to a spindle, wherein the length of the spindle is changeable by a screw means 54A, which is rotatably connected to a motor. The bi-directional one-way clutch mechanism 32A forces the elevator cars 34-1 and 34-2 to travel in the same direction at all times. The bi-directional one-way clutch mechanism 32B, affixed to the driveshaft of the driveshaft 24-2 and driveshaft extension 24B-2 (see FIG. 3), forces the elevator cars 34-2 and 34-3 to travel in the same direction at all times, is generally identical to the bi-directional one-way clutch mechanism 32A. The one-way clutch mechanisms 32A and 32B are interlocked so that all cars in the same shaft are forced to travel in the same direction all times. The coupling means 55A, which is a two-way clutch, is located between the clutch discs 32AA-L and 32A-R, and physically couples the elevator cars 34-1 and 34-2. The coupling means 55A connects and disconnects the driveshaft 24-2 and the driveshaft extension 24-2A, and by doing so, couples and de-couples the elevator cars 34-1 and 34-2. The coupling means 55B (see FIG. 3) that couples and de-couples the elevator cars 34-2 and 34-3 are generally identical in design to the coupling means 55A.

The bi-directional one-way clutch 32A allows the elevator cars 34-1 and 34-2 to travel only in the same direction at a time. The bidirectional one-way clutch 32B allows the elevator cars 34-2 and 34-3 to travel only in the same direction at a time. Thus, if any one of these three cars travels in one direction, the other two cars will have to travel in the same direction at any given time.

Reference is now made to FIG. 8 wherein a simplified schematic diagram showing an overall view of the elevator control system 60 of the elevator system 10 (see FIG. 1) is shown. The elevator control system 60 includes a schedule control computer 61 with a CPU and memory, at least one shaft control system 67 each of which includes a shaft computer 62 with a CPU and memory and controls an elevator shaft, and a plurality of car control systems 68-1, etc. each of which includes an on-board car computers (64-1 etc.) with a CPU and memory.

The schedule control computer 61, the shaft computers 62, and the car computers 64-1 etc. are connected by a local area network. FIG. 8 shows only one shaft and one car as an example, but the control system for shaft 1 is generally identical to all other shafts, and the control system for the elevator car 34-1 is generally identical to all other cars. The car computer 64-1 is equipped with hardware and software necessary to operate the elevator car 34-1 by itself or coupled with other cars in the same shaft. When the car 34-1 is in the coupled-operation mode, the car computer 64-1 shares relevant data with the other car computers of the coupled cars in the same shaft so that the elevator car 34-1 is able to operate in coordination with the other coupled cars.

The car control system 68-1 includes the car computer 64-1, an on-board location sensor 72-1, in-car request buttons 74-1, a means to control the car-motor 19-1, a means to control the brake mechanism 21-1, a means to control the car door motor 75-1. The car computer 64-1 receives data from the on-board location sensor 72-1 that detects the vertical location of the elevator car 34-1 in the shaft 12, stop requests from the in-car stop request buttons 74-1, and floor requests from floor request buttons 73; estimates the passenger count in the car; determines maximum car speed and the next floor at which the car stops (following the instruction from the schedule control computer 61); determines the time to close the car door if the car is open at a floor; sends control signals to the car motor 19-1, the brake mechanism 21-1, and a door motor 75-1; sends the passenger count and in-car stop request data to the schedule control computer 61. The car computer 64-1 also receives car location data from the car computers 64-2, and 64-3, and estimate the distance between the car 34-1 and the neighboring cars in the same shaft. The car computer 64-1 computes the speeds and acceleration rates of the car and the car ahead of it in the immediate past δt sec, and the distance between the car and the car ahead of it, and determines its acceleration rate in the immediate future δt sec every δt sec, wherein the δt may be 0.01 sec or less. The on-board car location sensor may be of a type as that uses a wheel to measure distance traveled in each trip, or a quasi-wayside type such type as that measures the number of rotations of a car motor.

The car control methods used in the preferred embodiment of the present invention includes that mimics car driver's behavior described in the so called car following models developed by transportation scientists in the 1950's and 1960's. If there is no car ahead of it, the car computer will use a predetermined acceleration and deceleration rates for car operation. If the car is following a car ahead of it, the acceleration (or deceleration) rate $dx_{n+1}(t+\delta t)^2/dt^2$ of the following elevator car at time t+δt may be determined from (1) below that shows a generalized nonlinear car following model developed by D. C. Gazis, R. Herman, and R. W. Rothery, and shown in an article entitled "Nonlinear Follow-the-Leader Models of Traffic Flow" published in Operations Research, 9, 545-567 (1961).

$$dx_{n+1}(t+\delta t)^2/dt^2=\alpha[dx_{n+1}(t+\delta t)/dt]^m/[x_n(t)-x_{n+1}(t)]^l\,[dx_n(t)^2/dt^2-dx_{n+1}(t)^2/dt^2] \quad (1)$$

wherein

- $\alpha$=a coefficient,
- $dx_{n+1}(t+\delta t)/dt$=speed of the following car at time t+δt,
- m=a real number,
- $x_n(t)$=location of the leading car at time t,
- $x_{n+1}(t)$=location of the following car at time t,
- l=a real number,
- $x_n(t)-x_{n+1}(t)$=distance between the leading car and the following car at time t,
- $dx_n(t)^2/dt^2$=acceleration/deceleration rate of the leading car at time t, and
- $dx_{n+1}(t)^2/dt^2$=acceleration/deceleration rate of the following car at time t.

The control method shown in (1) may be applied only when both leading and following cars are moving. When it is used, it will be selectively applied. For example, assume an up trip of the three cars in the same shaft wherein two cars are assigned to serve a floor group near the top of the building in the morning period, the first car does not need to use (1); the second car may not need to use (1) when the leading car (the first car) is far ahead of it, and the second car may use (1) some distance before it reaches the bottom floor of the served floor group only when the bottom floor is occupied by the moving leading car, but once it catches up the leading car the first and second car may be coupled together, and thus neither cars have to use (1).

Selection of a control method of the elevator car is one element in the elevator system design to improve operational efficiency that in turn would increase the shaft capacity. Other design elements that may be adopted include the use of a multiple-level lobby, and assignment of a different floor group to each elevator car in the shaft.

The shaft control system 67 includes the shaft computer 62, a means to control the one-way clutches 32A and 32B, a means to control the coupling means 55A and 55B, a plurality of location sensors 82-1, 82-2, and 82-3 (that are installed along each guide rail of the elevator shaft, and detect a specific point of a car wayside location sensors), cable elongation measuring means 88-1, 88-2, and 88-3, a means to control the jackscrew motor 89. The shaft computer 62, receives the location sensor data for elevator cars 34-1, 34-2, etc. from the wayside location sensors 82-1, 82-2, etc. embedded along the guide rails 37-1, 37-2, etc.; confirms current states of the one-way clutches 32A and 32B, and coupling means 55A and 55B; and sends their status data to the car computers 64-1, etc.; receives control commands from the schedule control computer 61, wherein the control commands include the floors each elevator cars serve; the cars to be coupled together; sends control signals to the bi-directional one-way clutch mechanisms 32A and 32B, and to the coupling means 55A and 55B. Directional stick D of the elevator shaft is an integer variable, wherein D=1 indicates that the direction the elevator cars is allowed to travel is "up," and D=−1 indicates that the direction the elevator cars is allowed to travel is "down." The directional stick is changed by the shaft computer 62 every time the last following car in the shaft reaches its destination floor, wherein the destination floor is the last floor of the floor group the car serves.

The shaft computer 62 is also connected to the motors 19-1 etc. and the brake mechanisms 21-1 etc. of the elevator car 34-1, etc. Using the wayside location sensor data, the shaft computer 62 computes the speed and acceleration rate of each elevator car and the distance between each elevator car pair in the shaft every δ sec. When the shaft computer 62 determines that any of the cars has violated the safety rule, it overrides the car computer 64-1 etc., and reduces the speed of the elevator car that violated the rule.

The shaft computer is also used for making adjustment for elongation of the hoist cables and the compensating cables. In the system that is equipped with the cable elongation adjustment mechanism as in the preferred embodiment, the platform 41 comprises two layers—the upper layer and the lower layer (see FIG. 2), and the upper layer 41U to which the motors and the interlocking means are affixed to is supported by a plurality of jackscrews that are affixed to the lower layer 41L and vertically movable. The lower layer 41L includes beams that are affixed to the structure of the elevator shaft 12. The jackscrews are connected to a motor that is operated by the shaft computer. The shaft computer periodically receives the measurement data from the cable elongation measuring means 88-1, etc., and computes the amount of adjustment to be made, and lifts up the platform 41 as the hoist cables and the compensating cables become longer as the building becomes older.

The schedule control computer 61, which has a plurality of pre-defined elevator control schedule tables 65 in its memory, reads in a predefined schedule from a schedule table 65; receives real-time floor requests from floor buttons 73 and manual interrupts 77; determines floor stopping policy for all elevator cars in the system; and sends data to the shaft computers 62 and to the car computers of all cars 34-1, 34-2, etc. in all shafts. The data sent by the schedule computer 61 to the shaft computer 62 include the start time and end time of coupling operation, number of cars to be operated, an operation schedule for each car in the system including the floor to stop next (which is updated δt every sec) and the raw floor request data. The car computer 64-1 communicates with the shaft computer 62-1 every δt sec, where δ is probably 0.01 second or shorter. The shaft computer 62-1 communicates with the schedule control computer 61 every $\delta_1$t sec, where $\delta_1$t is probably 1 sec or shorter. When a plurality of elevator cars are coupled together and operated in one shaft, each car computer controls the motor of each car in the coupled car-group. This means that if two cars are coupled together, time difference of up to 0.01 second is expected in start times and stop times of the drive motors of the two cars. In a large building, a plurality of the elevator systems 10 each including a plurality of elevator shafts and the elevator control system 60 may be used.

A different schedule table may be used for any given day. For example, one table may be used for an ordinary weekday operation, another table may be used for week end operation, and yet another table may be used for a special occasion. Each table will define the start time and end time of different operation methods. Some of operation methods include: (1) couple all or selected cars that are in consecutive floors during week-day peak periods, (2) couple all or selected empty cars in downward trips during week-day morning peak periods, and couple all or selected empty cars in upward trips during week-day evening peak periods, (3) couple only all those cars or selected that are closer than a pre-defined number of floors, (4) couple all or selected cars that are not in adjacent floors, (5) couple cars whenever more than one car is operated in the same shaft, and (6) couple cars whenever the following car catches up the leading car. Operating an elevator system that has coupled cars in one shaft requires a multi-level lobby in which these levels of the lobby are connected by escalators and stairs.

Figure 9:
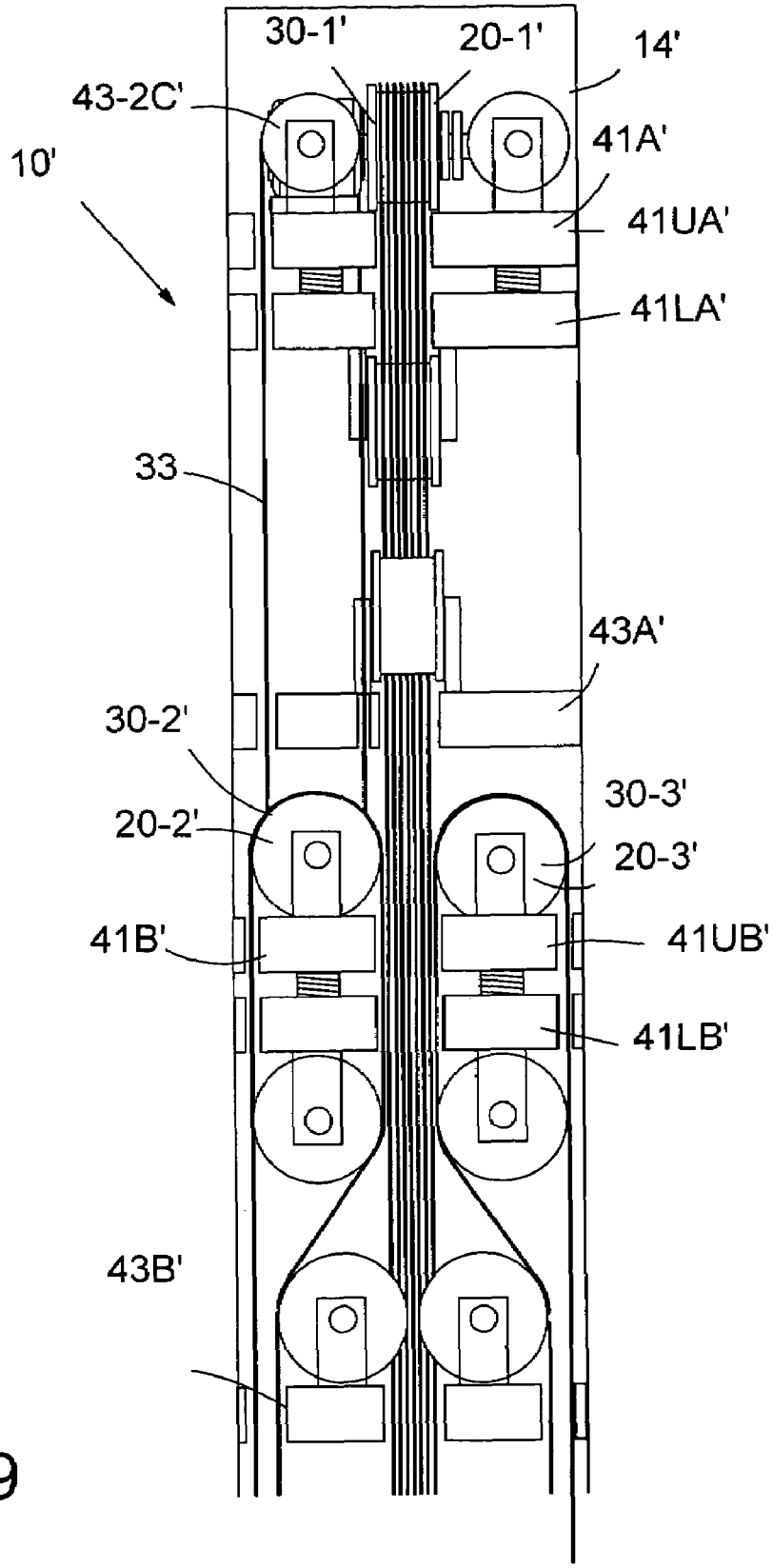
FIG. 9 shows a front view of the machine room of an alternative elevator system.
Figure 10:
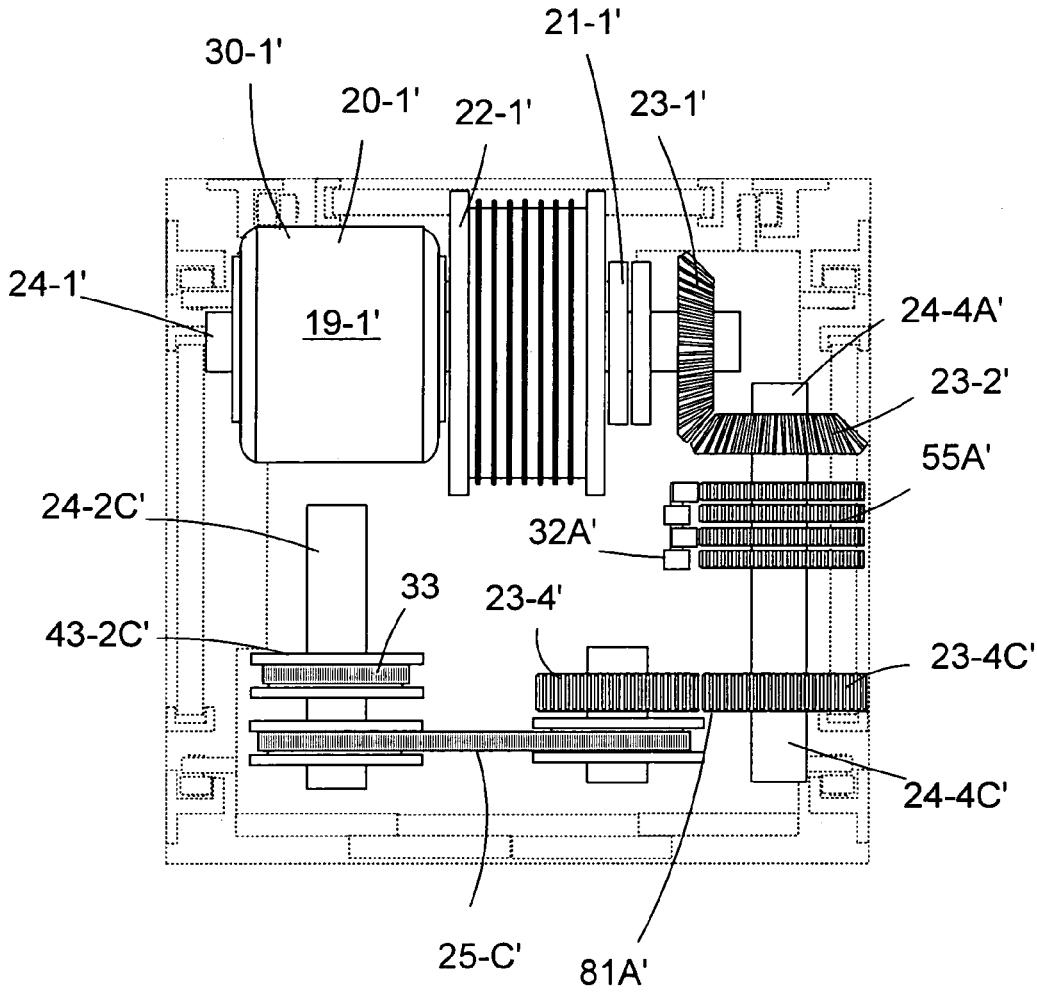
FIG. 10 shows a top view of the upper level of the machine room of the alternative elevator system.
Figure 11:
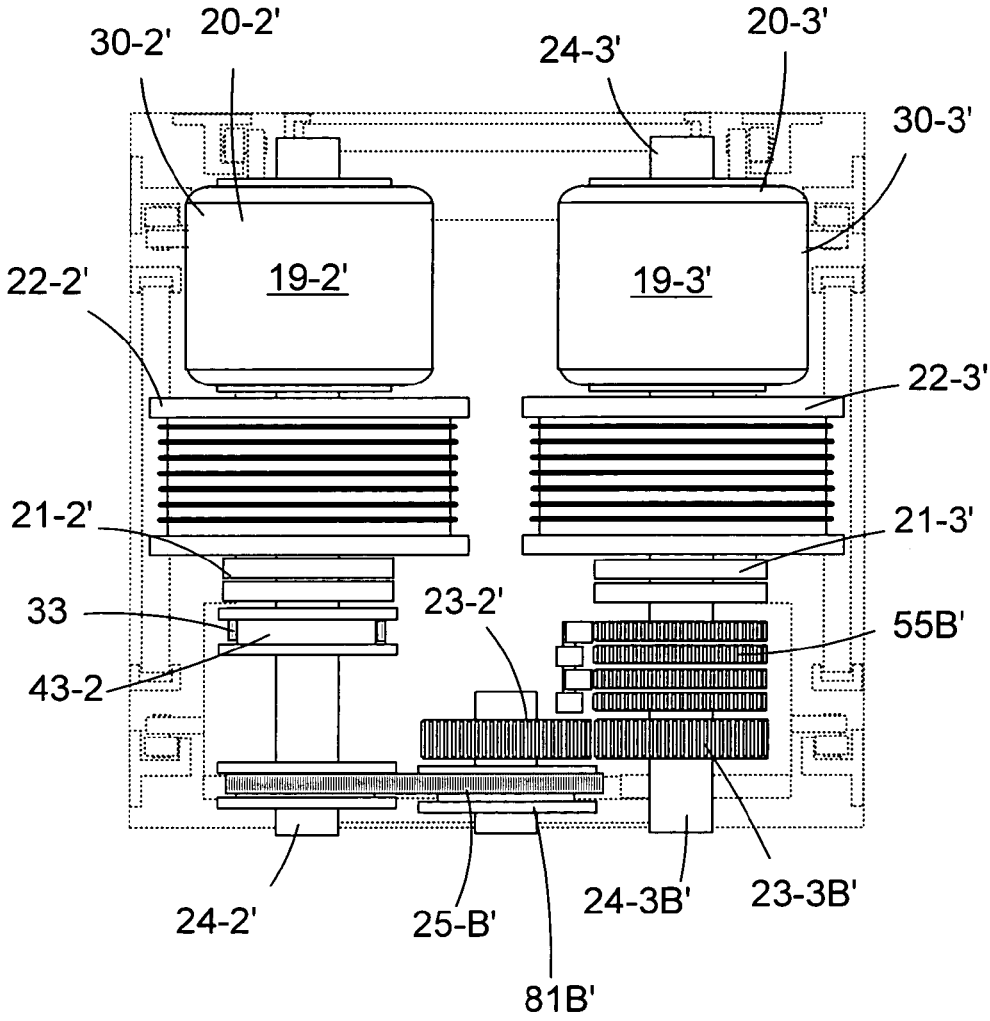
FIG. 11 shows a top view of the lower level of the machine room of the elevator system.

Reference is now made to FIGS. 9, 10, and 11. FIG. 9 shows a front view of a machine room 14' of an alternative elevator system 10' for a super high buildings with large motors and large traction sheaves. FIG. 10 shows a top view of the upper level of the machine room, and FIG. 11 shows a top view of the lower level of the machine room. The upper level of the machine room 14' has platforms 41A' and 43A' that support a drive means 20-1' of the elevator unit 30-1' and a part of an interlocking means 81A'. The lower level of the machine room 14' has platforms 41B' and 43B' that support drive means 20-2' of the elevator unit 30-2', the drive means 20-3' of the elevator unit 30-3', the rest of the interlocking means 81A', and an interlocking means 81 B'.

The drive means 20-1' includes a motor 19-1', a driveshaft 24-1', a traction sheave 22-1', a brake mechanism 21-1'. The drive means 20-2' includes a motor 19-2', a driveshaft 24-2', a traction sheave 22-2', and a brake mechanism 21-2'. The drive means 20-3' includes a motor 19-3', a driveshaft 24-3', a traction sheave 22-3', and a brake mechanism 21-3'.

The interlocking means 81A' includes a bevel gear 23-1' affixed to the driveshaft 24-1', and another bevel gear 23-2' affixed to an idler shaft 24-4A', a coupling mechanism 55A', a bi-directional one-way clutch 32A', a gear 23-4C' that is a part of a connecting means 25-C' and affixed to the idler shaft 24-4C', wherein 23-4C' is rotatably connected to a gear 23-4', a pulley 43-2C' (affixed to another idler shaft 24-2C'), a pulley 43-2 affixed to the driveshaft 24-2' and rotatably connected to through a chain 33. Both the coupling means 55A' and the bi-directional one-way clutch mechanism 32A' are partly affixed to the idler shaft 24-4A' and partly affixed to the driveshaft 24-4C'.

The interlocking means 81B' includes a driveshaft extension 24-3B', and a means 25-B' to rotatably connect the driveshaft 24-2', a coupling mechanism 55B', a bi-directional one-way clutch 32B', and the driveshaft extension 24-3B'. Both the coupling means 55B' and the bi-directional one-way clutch mechanism 32B' are partly affixed to the idler shaft 24-3B' and partly affixed to the driveshaft 24-2'. The drive means 20-2' and 20-3' share the coupling mechanism 55B' and the bi-directional one-way clutch mechanism 32B'. In a two-car per shaft elevator system, the elevator units 30-2' and 30-3' are used.

The platforms 41A' and 41B' comprise two layers—the upper layer and the lower layer (see FIG. 9), wherein the upper layers 41UA' and 41UA' of the platforms to which the motors and the interlocking means are affixed to are supported by a plurality of jackscrews that are affixed to the lower layers 41LB' and 41 LB', respectively, and the upper layers 41UA' and 41UB' are vertically movable. The jackscrews that support the upper layer 41UA' are connected to a motor, and the jackscrews that support the upper layer 41UB' are connected to another motor, and the two motors are controlled by the shaft computer. The shaft computer periodically computes the amount of adjustment to be made, and lifts up the platforms 41UA' and 41UB' as the hoist cables and the compensating cables become longer as the building becomes older.

An alternative embodiment of the present invention has three cars, 34-1", 34-2", and 34-3" per shaft, and either the top elevator car 34-1" or the bottom elevator car 34-3" of the three cars is a double-decker car. Another alternative embodiment is such that all the elevator cars 34-1", 34-2", and 34-3" are double-decker cars. Another alternative embodiment has two double-decker cars per shaft. Various designs of the coupling means are also possible, and the clutches and the bi-directional one-way clutches may be affixed to any two of the driveshafts of the drive means and their extensions. Another alternative embodiment uses sets of gears instead of clutches as the means to couple the driveshafts.

Another alternative embodiment of the present invention includes an auxiliary motor for each of the elevator units, wherein the auxiliary motor is installed at near the bottom of the shaft in a bottom machine room to drive the sheave that holds the compensating cable. The motor is connected to the car control computer by a communication means, and the car control computer coordinately operates the auxiliary motor and the primary motor that is in the machine room at the top of the shaft.

Figure 12:
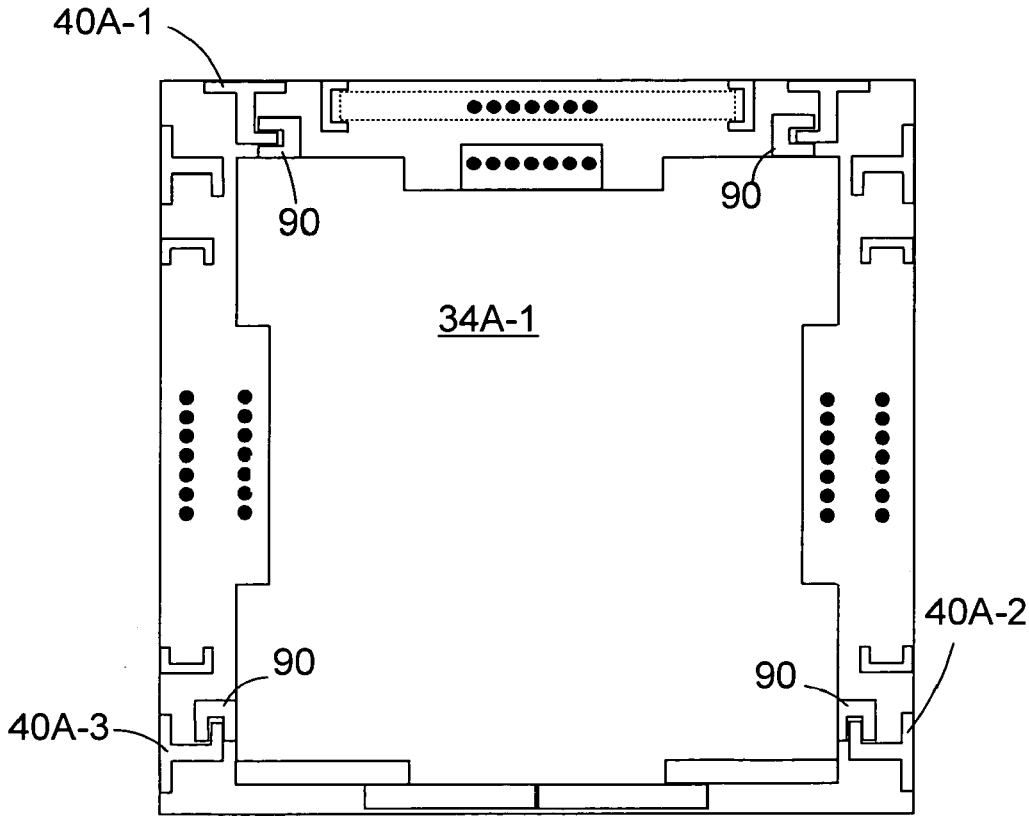
FIG. 12 shows a top view of an elevator car that is equipped with eddy current brakes.
Figure 13:
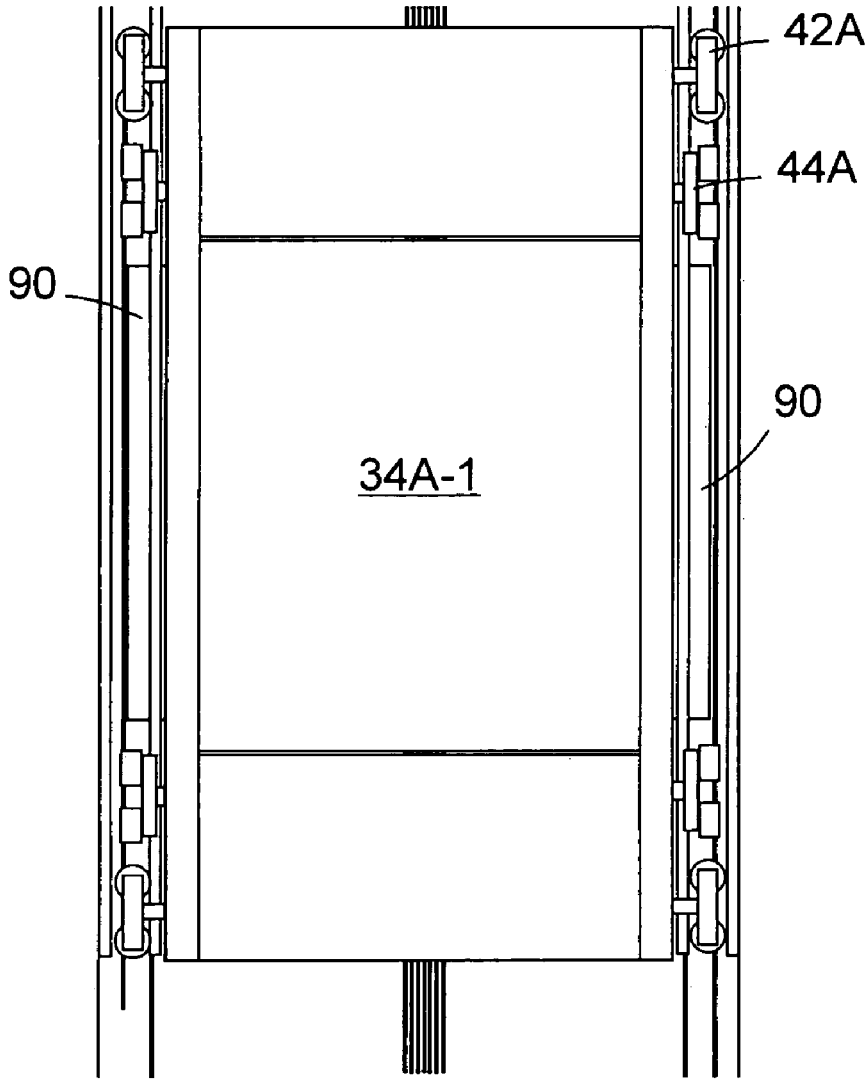
FIG. 13 shows a side view of the elevator car that is equipped with the eddy current brakes.

Reference is now made to FIGS. 12 and 13 wherein another alternative design that includes linear eddy current brakes 90 is shown. The eddy current brakes are affixed to the sides of the elevator car 34A-1 along guide rails 41A-1, 41A-2, and 41A-3 between upper and lower rollers 42A, and between upper and lower rollers 44A. The gap between the guide rails 41A-1 etc. and the eddy current brakes 90 are adjusted by the car computer 64-1 on an on-line real-time basis. The eddy current brake means 90 is used to prevent over speeding of the elevator car 34A-1. The eddy current brake means 90 may also be used as a surrogate for balancing weight that will even out the weight difference between the elevator car plus the hoist cables and the counterweight plus the hoist cables. In such a system, the elevator car will be equipped with a passenger weight measuring means that is connected to the car computer 64-1, which will adjust the amount of braking force to be applied.

Figure 14:
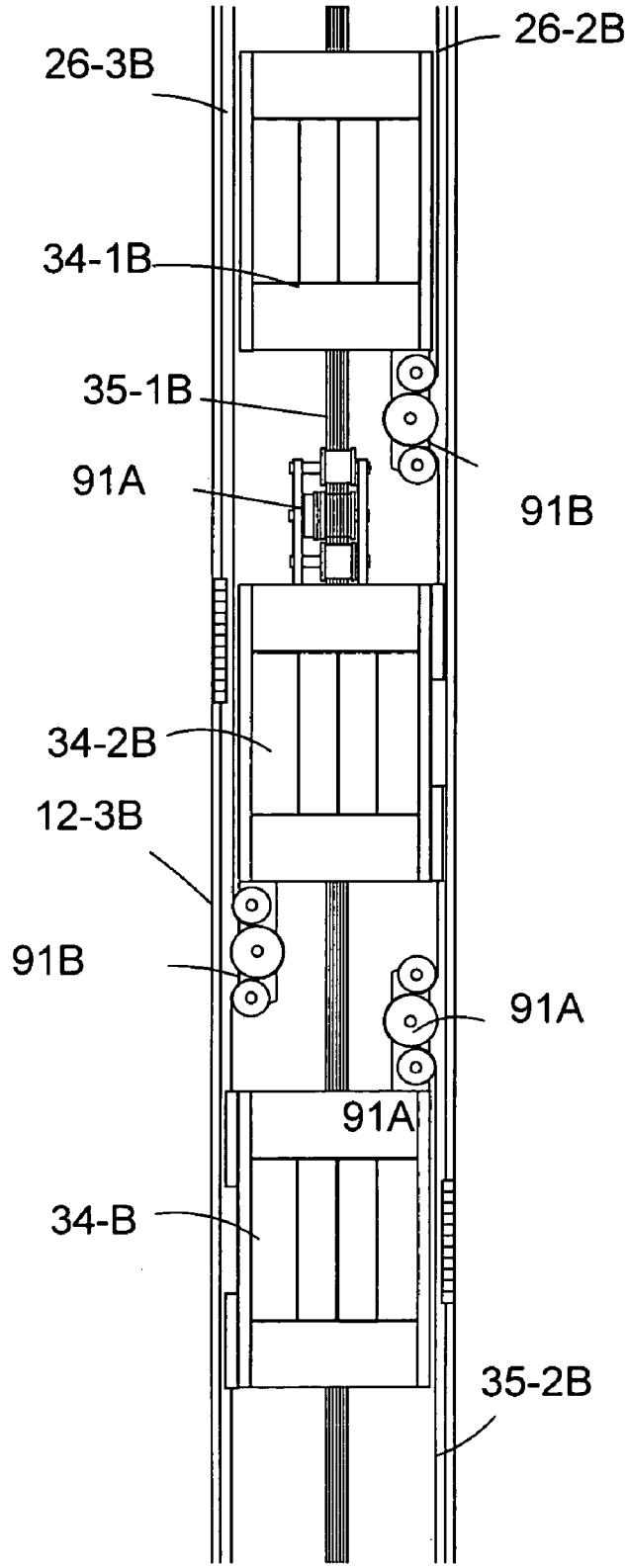
FIG. 14 shows a front view of an elevator shaft that includes elevator cars equipped with an on-board collision prevention mechanism.
Figure 15:
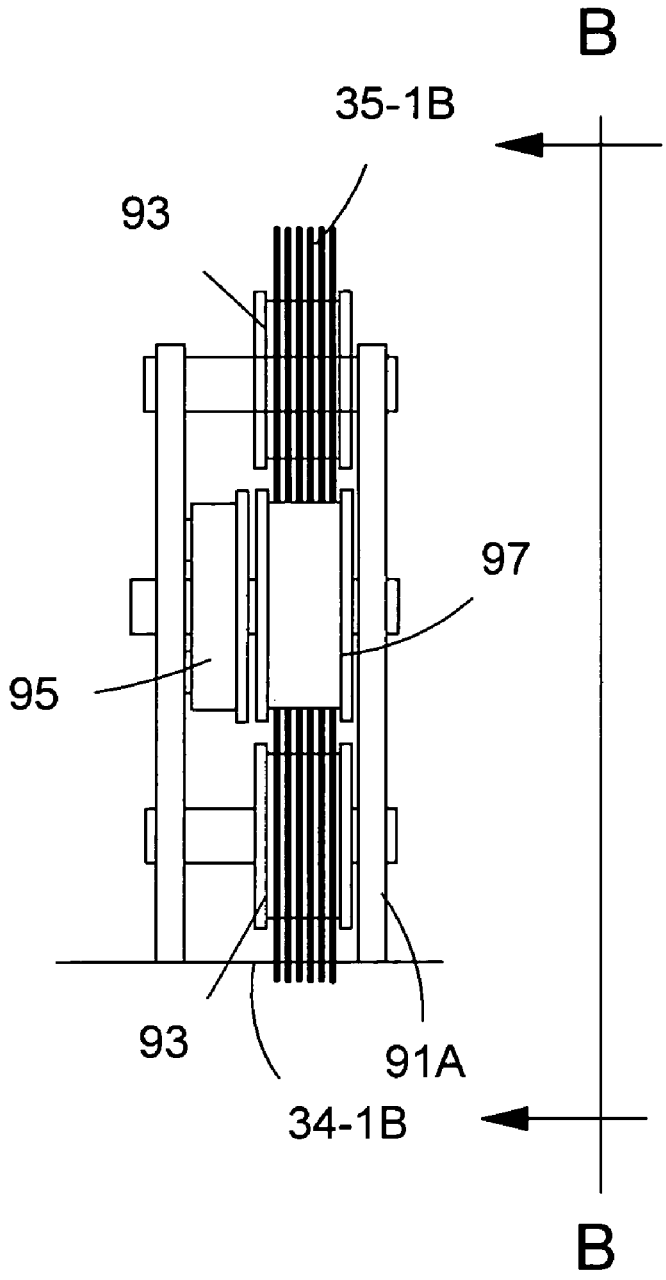
FIG. 15 shows a front view of the on-board collision prevention mechanism taken along C-C of FIG. 16.
Figure 16:
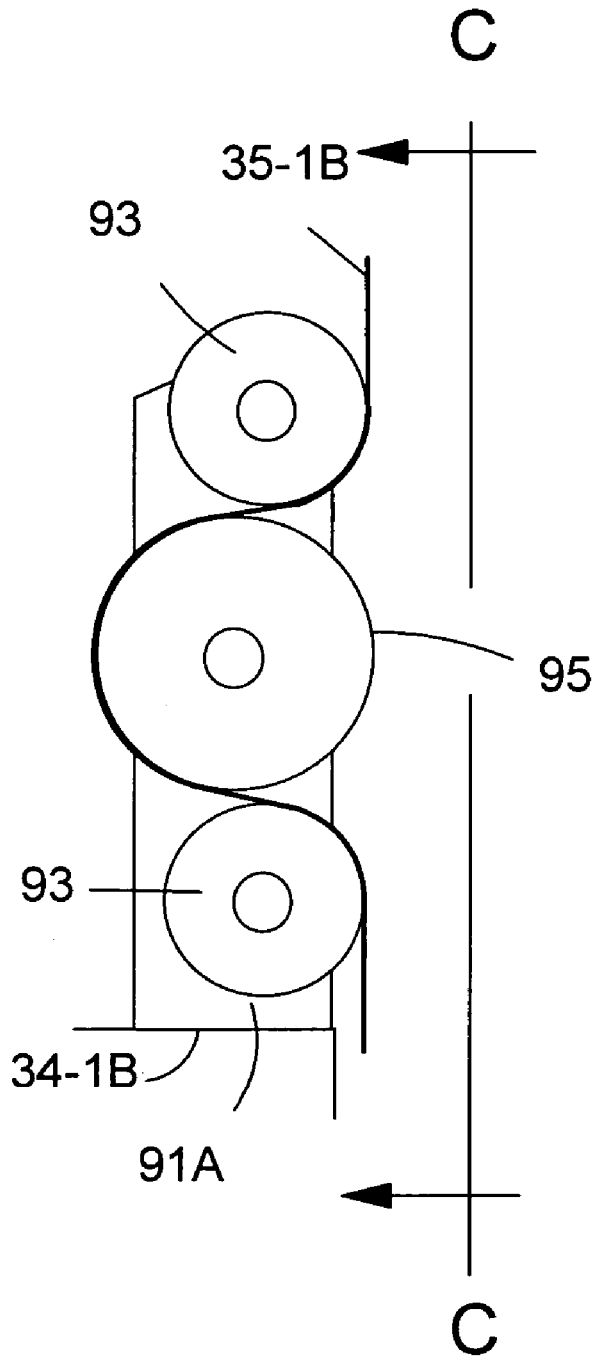
FIG. 16 shows a side view of the on-board collision prevention mechanism taken along B-B of FIG. 15.

Reference is now made to FIGS. 14 through 16, wherein another alternative embodiment that includes on-board collision prevention mechanisms 91A and 91B is shown. The on-board collision prevention mechanism 91A is affixed to the top of an elevator car that is not the top car in a shaft, and the on-board collision prevention mechanism 91B is affixed to the bottom of an elevator car that is not the bottom car in a shaft. In FIG. 14, the elevator cars 34-2B and 34-2B are equipped with the on-board collision prevention mechanism 91A, and the elevator cars 34-1B and 34-2B are equipped with the on-board collision prevention mechanism 91B. The on-board collision prevention mechanisms 91A prevents occurrence of collisions between the two neighboring elevator cars in the same shaft during the up trip, and the on-board collision prevention mechanism 91B prevents occurrence of collisions between the two neighboring elevator cars in the same shaft during the down trip.

The mechanisms 91A and 92B are generally identical in design. As is shown in FIGS. 15 and 16 the on-board collision prevention mechanism 91A that is affixed to the top of the elevator car 34-2B comprises a sheave 95 that holds the compensating cables 35-1B, two idler sheaves 93 that guide the compensating cables into the sheave 95. A side of the sheave 95 is a disc surface of a disc brake means 97 that regulates the rotational speed of the sheave 95.

The on-board collision prevention mechanisms 91A and 91B are controlled by an on-board collision prevention mechanism control system that includes an on-board computer whose sole purpose is to operate the mechanisms 91A and 91 B. The on-board computer is connected to an independently operated distance-measuring device that measures the distance between the car and the car ahead of it, affixed to the top of the elevator car 34-2B (see FIGS. 15 and 16). The on-board computer measures its (car 34-2B) own operational speed using data obtained from independently operated on-board location sensor, estimates the leading car's (elevator car 34-1B) operational speed from its own speed and the rotational speed of the sheave 94B; estimates the distance between the elevator car 34-2B and the elevator car 34-1B; and estimates the acceleration (or deceleration) rates of the two cars every δ sec from the location data of the two cars. The on-board computer is connected to the brake means 97, and will give a brake if it determines that the elevator car has violated its predefined operational rule. The on-board collision prevention mechanism control system will become a part of the car control system 68.

The on-board collision prevention mechanisms 91A and 92B may be used as a coupler of the two neighboring elevator cars in the same shaft.

The invention having been described in detail in accordance with the requirements of the U.S. Patent Statutes, various other changes and modifications will suggest themselves to those skilled in this art. For example, a linear induction motor may be affixed to the elevator car and/or to the counterweight. It is intended that the above and other such changes and modifications shall fall within the spirit and scope of the invention defined in the appended claims.

I claim:

1. An elevator system comprising at least one elevator shaft, and an elevator control system, wherein said elevator shaft having a plurality of elevator units and at least one interlocking means, wherein said elevator unit including an elevator car and its guide means, a counterweight and its guide means, and a drive means, wherein said drive means including a motor, hoist cables, a traction sheave, a brake mechanism, said interlocking means including a coupling mechanism and a bi-directional clutch mechanism, wherein said bi-directional clutch mechanism allows said elevator cars in said shaft to travel only in same direction at a time, said elevator control system including a plurality of car computers, at least one shaft computer, at least one schedule control computer wherein said car computer controlling said elevator car unit, said shaft computer controlling said interlocking means, said schedule control computer controls floor stopping policy, and said car computer computes its speed, acceleration rate.

2. The elevator system as defined in claim 1 wherein said elevator system having means to automatically make adjustment for elongation of said hoist cables.

3. The elevator system as defined in claim 1 wherein said elevator system having at least first and second elevator car units, said first elevator car unit including an on-board collision prevention mechanism for down trip and said second elevator car unit including an on-board collision prevention mechanism for up trip, wherein said on-board collision prevention mechanism for up trip including a sheave that holds said compensating cables of said first elevator unit, a brake means to reduce the speed of said sheave that holds said compensating cables, and said on-board collision prevention mechanism for down trip including a sheave that holds said hoist cables of said first elevator unit, a brake means to reduce the speed of said sheave that holds said hoist cables.

4. The elevator system as defined in claim 1 wherein said elevator car unit having a linear eddy current brake.

5. The elevator system as defined in claim 1 wherein said car computer uses the car-following control method in the operation of the following elevator car.

6. The elevator system as defined in claim 1 wherein said elevator system having a multiple-level lobby.

7. The elevator system as defined in claim 1 wherein said schedule control computer of said elevator control system having a plurality of schedule tables.

8. The elevator system as defined in claim 7, wherein said schedule table defines start time and end time of different control methods.

9. The elevator system as defined in claim 7 wherein said control methods include coupling operation wherein said control method specifies location at which said elevator cars are coupled and decoupled.

10. The elevator system as defined in claim 7 wherein said elevator system operating during peak periods and off-peak periods, said elevator cars in said shaft being coupled together during said peak periods, and said elevator cars in said shaft being operated without coupling during said off-peak periods.

11. The elevator system as defined in claim 1 wherein said schedule control computer having at least one operation method, and said operation method including coupling cars that are in consecutive floors during peak periods.

12. The elevator system as defined in claim 1 wherein said schedule control computer having at least one operation method, and said operation method including coupling empty cars in downward trips during morning peak periods, and coupling empty cars in upward trips during evening peak periods.

13. The elevator system as defined in claim 1 wherein said schedule control computer having at least one operation method, and said operation method including coupling cars that are closer than a pre-defined number of floors.

14. The elevator system as defined in claim 1 wherein said schedule control computer having at least one operation method, and said operation method including coupling cars that are not in adjacent floors.

15. An elevator system comprising at least one elevator shaft, and an elevator control system, wherein said elevator shaft having a plurality of elevator units, at least one interlocking means, and a cable elongation adjustment mechanism, said elevator unit including an elevator car and its guide means, a counterweight and its guide means, and a drive means, wherein said drive means including a motor, hoist cables, a traction sheave, a brake mechanism, said interlocking means including a coupling mechanism and a bi-directional clutch mechanism, wherein said bi-directional clutch mechanism allows said elevator cars in said shaft to travel only in same direction at a time, said elevator control system including a plurality of car computers, at least one shaft computer, at least one schedule control computer wherein said car computer controlling said elevator car unit, said shaft computer controlling said interlocking means, and said schedule control computer controls floor stopping policy.

16. An elevator system comprising at least one elevator shaft, and an elevator control system, wherein said elevator shaft having at least first and second elevator units, said first elevator car unit including an on-board collision prevention mechanism for down trip and said second elevator car unit including an on-board collision prevention mechanism for up trip, wherein said on-board collision prevention mechanism for up trip including a sheave that holds said compensating cables of said first elevator unit, a brake means to reduce the speed of said sheave that holds said compensating cables, and said on-board collision prevention mechanism for down trip including a sheave that holds said hoist cables of said first elevator unit, a brake means to reduce the speed of said sheave that holds said hoist cables.

* * * * *